US009299509B2

(12) United States Patent
Coquil et al.

(10) Patent No.: US 9,299,509 B2
(45) Date of Patent: Mar. 29, 2016

(54) ELECTRICAL SWITCHING DEVICE, NOTABLY FOR DIRECT CURRENT, EQUIPPED WITH A MAGNETIC MODULE FOR BLOWING THE ELECTRIC ARC

(71) Applicant: SOCOMEC S.A., Benfeld (FR)

(72) Inventors: Karine Coquil, Flexbourg (FR); Jerome Hertzog, Benfeld (FR)

(73) Assignee: Socomec S.A., Benfeld (FR)

( * ) Notice: Subject to any disclaimer, the term of this patent is extended or adjusted under 35 U.S.C. 154(b) by 294 days.

(21) Appl. No.: 13/900,835

(22) Filed: May 23, 2013

(65) Prior Publication Data

US 2014/0346144 A1 Nov. 27, 2014

(51) Int. Cl.

| | |
|---|---|
| ***H01H 9/44*** | (2006.01) |
| ***H01H 1/20*** | (2006.01) |
| ***H01H 33/59*** | (2006.01) |

(52) U.S. Cl.

CPC ..... *H01H 9/443* (2013.01); *H01H 1/2041* (2013.01); *H01H 33/596* (2013.01)

(58) Field of Classification Search

CPC ..... H01H 9/44; H01H 9/443; H01H 9/30
USPC ..... 218/22–26, 146–151; 335/201, 202
See application file for complete search history.

(56) References Cited

U.S. PATENT DOCUMENTS 5,004,874 A * 4/1991 Theisen et al. ..... 218/151
7,259,646 B2 8/2007 Rab et al.

FOREIGN PATENT DOCUMENTS

FR 2 622 736 A1 5/1989
JP 2011-150983 A 8/2011

* cited by examiner

*Primary Examiner* — Amy Cohen Johnson
*Assistant Examiner* — Marina Fishman
(74) *Attorney, Agent, or Firm* — Davis & Bujold PLLC; Michael J. Bujold

(57) ABSTRACT

An electrical switching device (1) which comprises at least one double breaking pole provided with two fixed contacts (3, 4) that cooperate with two moving contacts (5, 6) arranged so as to move in a breaking plane (P) and define, with every fixed contact, a breaking zone. The device comprises a permanent magnet (11, 12) housed in an insulating holder arranged in the immediate environment, next to each breaking zone, symmetrically with respect to the breaking plane and oriented so as to generate a magnetic excitation vector parallel to the breaking plane (P) so that the induced electromagnetic force (FE) moves and stretches every electric arc (E1, E2), generated when opening the electrical circuit, in a direction perpendicular to the breaking plane (P), leading to the extinction of the electric arc regardless of the polarity of the magnet and/or of the current.

13 Claims, 5 Drawing Sheets

ELECTRICAL SWITCHING DEVICE, NOTABLY FOR DIRECT CURRENT, EQUIPPED WITH A MAGNETIC MODULE FOR BLOWING THE ELECTRIC ARC

TECHNICAL SCOPE

The present invention relates to an electrical switching device, notably for direct current, equipped with a magnetic module for blowing the electric arc, said switching device including at least a housing that delimits at least one breaking pole comprising at least one first fixed contact that cooperates with at least one first moving contact, said moving contact being arranged so as to move in a plane called breaking plane and to define with said first fixed contact a first breaking zone in which a first electric arc extends when opening the electrical circuit.

PRIOR ART

Electrical switching devices comprising a magnetic module contributing to the control of the electric arc generated when opening the electrical circuit are already known. In most of the cases, these switching devices comprise at least one splitting chamber for the electric arc and the magnetic module comprises at least one permanent magnet arranged so as to blow magnetically the electric arc towards and into this splitting chamber. In this configuration, the polarity of the magnets with respect to the electrical circuit is important and must be observed. If this is not the case, the purpose would not be achieved. Examples are in particular illustrated in publications FR 2 622 736 B1 and U.S. Pat. No. 7,259,646 B2.

Other switching devices suggest to replace the splitting chamber and to control the electric arc with a magnetic module that, in this case, is configured differently. One of the examples is in particular illustrated in publication JP 2011-150983 A, which describes a switching device for direct current that can be, if necessary, modified for alternating current, this device comprising two parallel push contacts. To that purpose, it comprises a removable magnetic module for blowing the arc, in the form of an insulating magnet-holding box that can be fitted in a housing of the device. This box serves as a holder for two parallel permanent magnets whose magnetic field is oriented in a same direction. Each permanent magnet is arranged next to one of the two parallel breaking zones in order to move electromagnetically the electric arc towards the right or left side of the housing of the device. Theoretically, the polarity of the magnets with respect to the electrical circuit is not relevant. However, according to the polarity of the magnets with respect to the electrical circuit, the electric arcs generated by the two parallel push contacts and moved by these permanent magnets may interfere with each other and build up between other components of the switching device, where they might create damages. On the other hand, the permanent magnets are very close to each other and their respectively produced magnetic fields may interfere with each other, which may penalize the control of the electric arcs. So, the disconnection management of such a device is not optimal.

DESCRIPTION OF THE INVENTION

The present invention aims to overcome these disadvantages by offering a switching device equipped with a magnetic module specially designed and adapted for blowing the electric arc in the case of electrical contacts operating in a breaking plane, providing a reliability and efficiency in the control of the electric arc that are totally independent of the polarity of the magnetic module and of the direction of connection of said switching device to an external electrical circuit, allowing to simplify and to reduce the manufacturing costs of such switching device, but also to increase notably its disconnecting capabilities, which allows either to increase the disconnection voltage for a switching device with the same size or to reduce the size of said device for the same disconnection voltage.

To that purpose, the invention relates to a switching device of the kind stated in the preamble, characterized in that said magnetic module comprises a first permanent magnet housed in a first insulating holder, said first permanent magnet being arranged in the immediate environment, next to the first breaking zone, symmetrically with respect to said breaking plane and oriented so as to generate a magnetic excitation vector parallel to said breaking plane, so that the induced electromagnetic force moves and stretches said first electric arc perpendicularly to said breaking plane, independently in one direction or in the other, according to the polarity of said first permanent magnet and/or of said current.

In the case of a double breaking pole, said magnetic module comprises advantageously a second permanent magnet housed in a second insulating holder, said second permanent magnet being arranged in the immediate environment, next to a second breaking zone, symmetrically with respect to said breaking plane and oriented so as to generate a magnetic excitation vector parallel to said breaking plane, so that the induced electromagnetic force moves and stretches a second electric arc perpendicularly to said breaking plane, in one direction or in the other, according to the polarity of said second permanent magnet and/or of said current.

In this case, said first and second permanent magnets are advantageously arranged at a distance from each other, symmetrically with respect to a median axis or to a median plane of said device so that said electromagnetic forces induced by said first and second permanent magnets have parallel and distant directions. The electromagnetic force induced by each permanent magnet is thus perpendicular to two walls, which are parallel and symmetrical with respect to said breaking plane of the housing of said electrical switching device.

In a preferred embodiment, the first and second permanent magnets are identical, parallel and distant from each other so that their respective magnetic fields do not interfere. In this case, said first and second insulating holders are also identical.

Said insulating holder may comprise assembly means complementary to receiving means provided in the housing of said electrical switching device in order to position said insulating holder next to and parallel to the breaking zone.

In a preferred manner, said insulating holder includes a housing provided with a lateral opening that extends perpendicularly to said breaking zone and in which said permanent magnet is inserted. This insulating holder is advantageously extended on the side of its lateral opening and in front of said breaking zone by at least one deflector that extends parallel and in front of said breaking zone in order to protect said permanent magnet against said electric arc.

In an embodiment variant, said permanent magnet can be associated with at least one electric (magnetic) sheet arranged so as to canalize the magnetic flux of said permanent magnet towards said breaking zone. This electric (magnetic) sheet can be housed with said permanent magnet in said insulating holder.

This electric (magnetic) sheet may have a flat shape so as to cover the rear side of said permanent magnet opposite to said breaking zone, or a U-shape so as to cover the rear side of said permanent magnet opposite to said breaking zone and its two lateral sides.

BRIEF DESCRIPTION OF THE DRAWINGS

The present invention and its advantages will be better revealed in the following description of several embodiments given as non limiting examples, in reference to the drawings in appendix, in which.

ILLUSTRATIONS OF THE INVENTION AND DIFFERENT WAYS OF REALIZING IT

Figure 1:
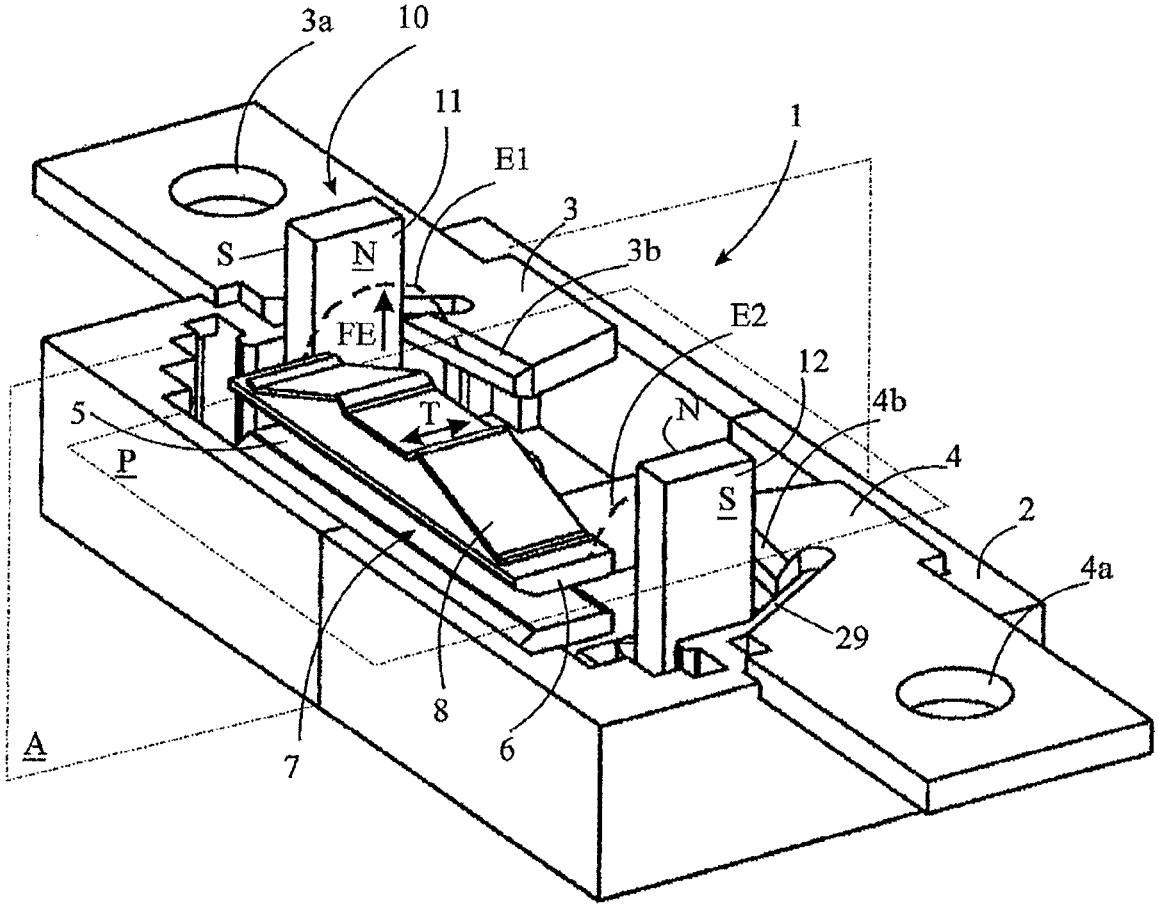
FIG. 1 is a perspective view of a double breaking pole belonging to a switching device according to the invention, provided with sliding contacts and showing the location of the permanent magnets in both breaking zones.
Figure 2:
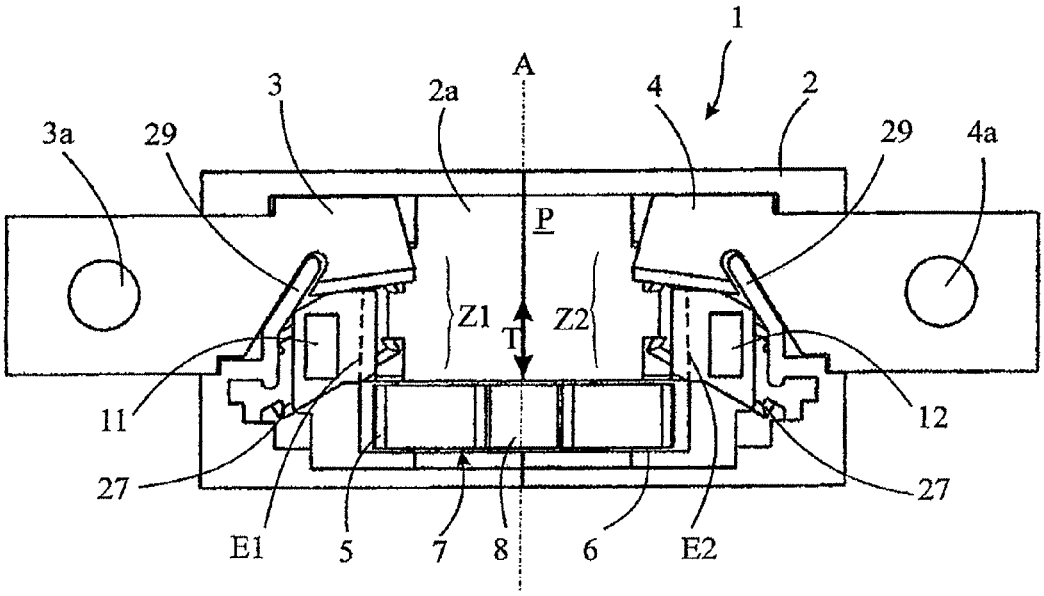
FIG. 2 is a top view of the double breaking pole of FIG. 1.

With reference to the figures, the electrical switching device 1, 100, 110 is intended to disconnect in particular a low-voltage (i.e. lower than 1,500 V) direct current such as for example in photovoltaic or similar applications. This device is illustrated in the figures with one single breaking pole housed in a partly represented electrically insulating housing 2, 200, 210, but it can naturally include several breaking poles assembled side by side in one single housing or in juxtaposed individual housings. The breaking pole may also be a single breaking pole as represented in FIGS. 4 and 5 or a double breaking pole as represented in FIGS. 1 to 3, 7 and 8. In all represented cases, the electrical contacts operate in a breaking plane. They are called sliding contacts, unlike the state-of-the-art push contacts. In the various embodiment variants, identical parts have the same reference number.

The electrical switching device 1, 110, provided with a double breaking pole according to FIGS. 1 to 3, 7 and 8, comprises a first fixed contact 3, 310 and a second fixed contact 4, 410, aligned and symmetrical with respect to a median plane A of housing 2, 210, cooperating respectively with a first moving contact 5, 510 and a second moving contact 6, 610 firmly mounted on a bridge 7, 710 movable in translation with respect to said fixed contacts in a plane called breaking plane P perpendicular to median plane A. The fixed contacts 3, 4 and 310, 410 are made each of a metal blade, extended by a connection terminal 3*a*, 4*a* for connection to an external electrical circuit, and provided with a chamfer lead 3*b*, 4*b* that facilitates the approach and the climbing of the moving contacts 5, 6 and 510, 610. The moving contacts 5, 6 and 510, 610 are firmly mounted on a movable bridge 7, 710 made of two parallel metal blades pressed against each other by means of a spring element 8, 810 and arranged to approach and climb on the fixed contacts 3, 4 and 310, 410 while maintaining said contacts under pressure in order to ensure an optimized closure of the electrical circuit. These electrical contacts are commonly called sliding contacts since the moving contacts 5, 6 and 510, 610 are in sliding connection with the fixed contacts 3, 4 and 310, 410. In addition, the fact that the fixed and moving contacts are doubled facilitates the operation of the movable bridge 7, 710 and improves the global disconnecting performances. In this embodiment, the movable bridge 7, 710 can be moved in the breaking plane P by a translation movement according to arrow T in compliance with FIGS. 1 to 3 and 7, or by a rotary movement according to arrow R around a median axis B in compliance with FIG. 8, these movements being obtained by means of a known and not represented actuating mechanism. In the rotary embodiment, the electrical switching device 110 is symmetrical with respect to this median axis B.

The fixed contacts 3, 4, 310, 410 and the moving contacts 5, 6, 510, 610 define between themselves respectively a first breaking zone Z1 in which a first electrical arc E1 extends and a second breaking zone Z2 in which a second electrical arc E2 extends when opening said electrical circuit, said electrical arcs E1, E2 being represented in dotted lines in the figures. These first and second breaking zones Z1, Z2 are of course located in breaking plane P, the electric arc E1, E2 inscribing itself in this breaking plane P when it appears.

The electrical switching device 1, 110 according to the invention is equipped with a magnetic module 10 for blowing the electric arc E1, E2, which can replace or complete the traditionally known splitting chambers, depending on the required disconnecting capabilities. In the represented examples, the magnetic module 10 is sufficient to reach disconnecting capabilities higher than those reached with classical splitting chambers, without modifying the size of said switching device. This magnetic module 10 comprises, for every breaking pole and on each side of the movable bridge 7, 710 carrying the moving contacts, a first permanent magnet 11 arranged next to the first breaking area Z1 close to electric arc E1, and a second permanent magnet 12 arranged next to the second breaking area Z2 close to electric arc E2. More precisely, each permanent magnet 11, 12 is located at the end of each fixed contact 3, 4 and 310, 410, on the side of the lead chamfer 3*b*, 4*b* and on the edge of the movement area of the corresponding moving contact 5, 6 and 510, 610. Consequently, the two permanent magnets 11, 12 of each breaking pole are parallel, arranged symmetrically with respect to breaking plane P and symmetrically with respect to median plane A or median axis B, distant from each other so that their magnetic fields do not interfere with each other. These permanent magnets 11, 12 are identical and can have each a parallelepiped shape with dimensions that can be inscribed in the close environment of breaking zones Z1, Z2. They are housed each in an insulating holder 20 as described below, which protects them electrically against said electrical arcs E1, E2, this insulating holder 20 being represented only in FIGS. 6, 7 and 9 to avoid overloading the other figures.

Figure 3:
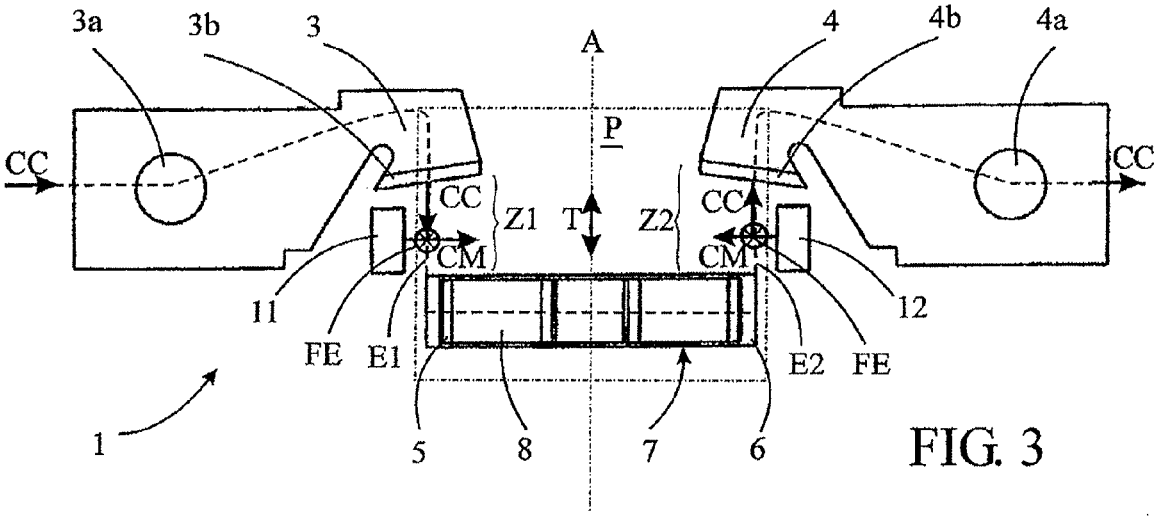
FIG. 3 is a view similar to FIG. 2 without the housing of the double breaking pole, showing the location of the permanent magnets in both breaking zones.
Figure 4:
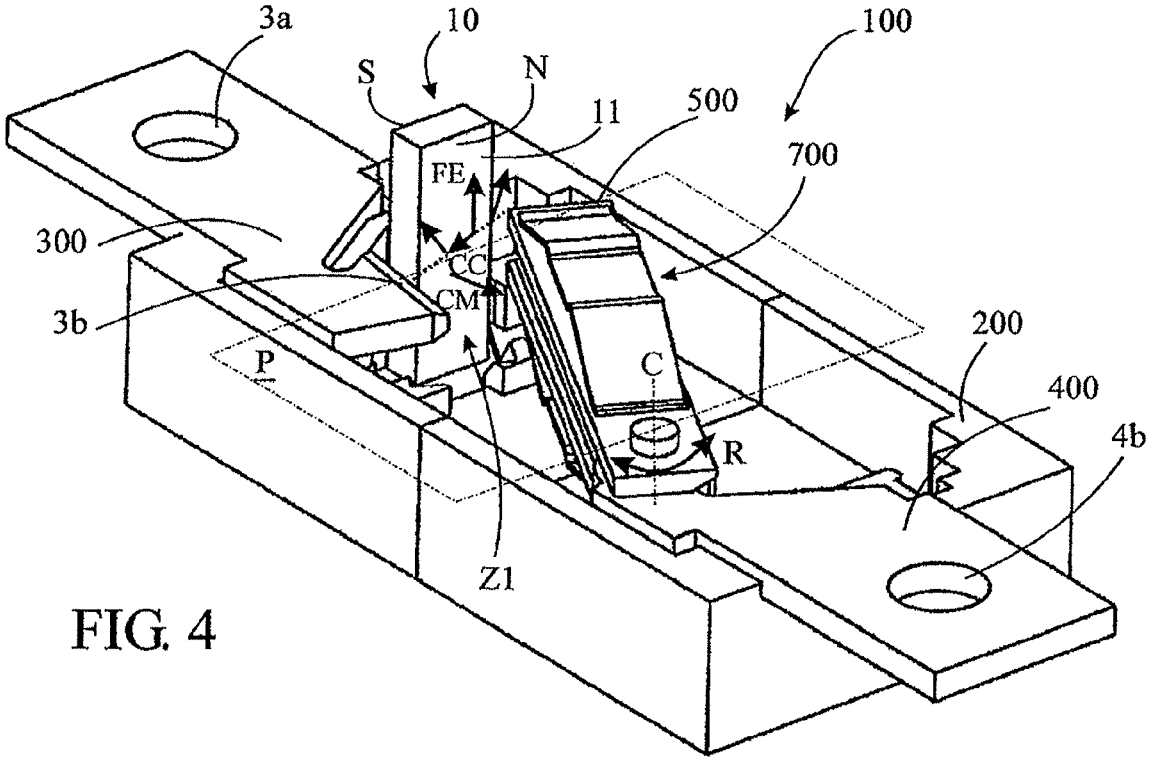
FIGS. 4 and 5 are perspective views of a simple breaking pole belonging to another switching device according to the invention, provided with sliding contacts and showing the stretching of the electric (magnetic) arc due to the electromagnetic force induced by the permanent magnets at two stages of the opening of the moving contact.
Figure 5:
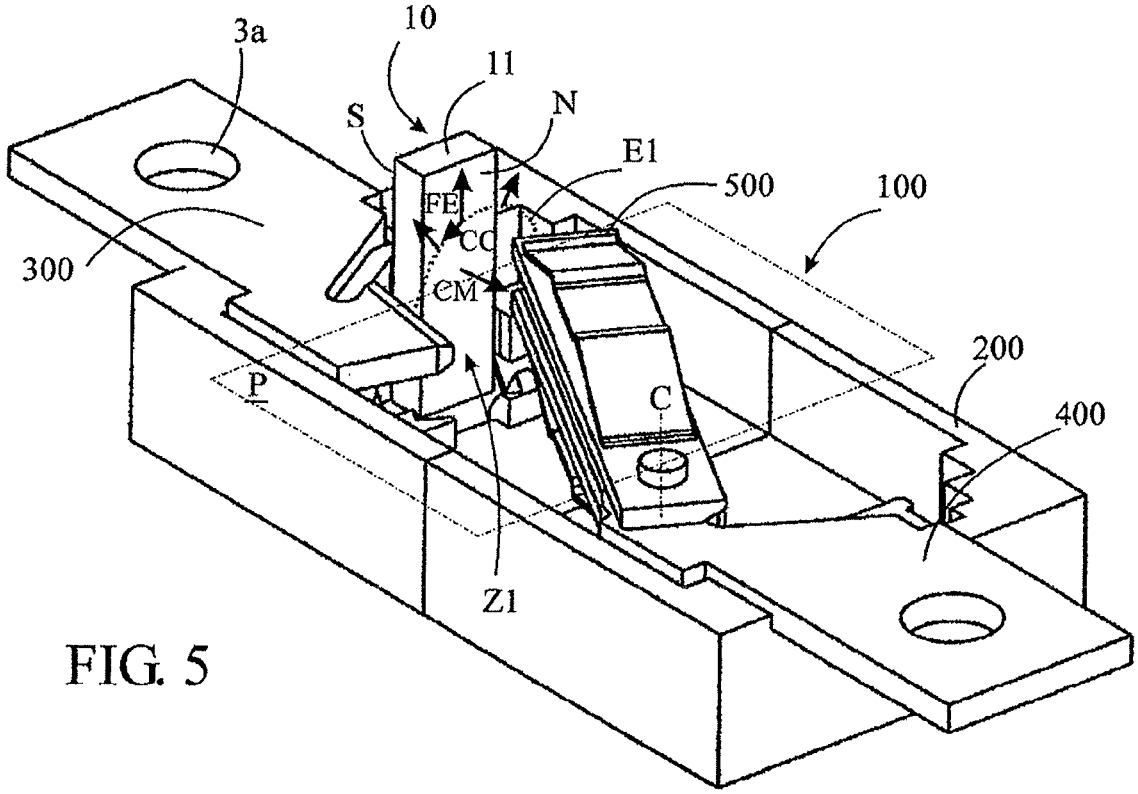

The role of these permanent magnets 11, 12 is described more specifically with reference to FIGS. 3 to 5. Each permanent magnet 11, 12 is positioned in housing 2, 210 in order to locate one of its sides, North or South, next to the breaking zone Z1, Z2 in front of which it is positioned. So, the magnetic field CM it produces or its magnetic excitation vector that leaves its North pole and loops on its South pole is essentially parallel to breaking plane P, and therefore perpendicular to the direct current CC that circulates between the fixed contacts 3, 4, 310, 410 and the corresponding moving contacts 5, 6, 510, 610. To that purpose, one will choose independent permanent North-South magnets 11, 12 whose magnetic field loops on themselves, with North-South sides perpendicular to said breaking plane P. In the illustrated example, the magnetic field CM produced by every permanent magnet 11, 12 is directed towards the cutting zone Z1, Z2 it is facing, so that the magnetic fields CM of the two permanent magnets 11, 12, are opposite. The orientation of this magnetic field CM depends of course on the polarity of every permanent magnet 11, 12, which is not relevant in the present invention, so that every permanent magnet 11, 12 can independently show one of its North or South sides in front of breaking zone Z1, Z2. This is why both permanent magnets 11, 12 are perfectly identical and may be mounted in housing 2, 210 independently of their polarity, in one direction or in the other direction, as explained below, which allows standardizing the permanent magnet and simplifying considerably its implementation and mounting. Still in the represented example, the direct current CC circulates from left to right in FIG. 3, i.e. it enters via fixed contact 3 and exits via fixed contact 4. The presence of a magnetic field CM and of a direct current CC generates an electromagnetic force FE called Laplace force that exerts on the electric arc E1, E2 created when opening the fixed and moving contacts and that extends in a direction perpendicular to said breaking plane P. This electromagnetic force FE has the technical effect of moving and stretching said electric arc E1, E2 perpendicularly to said breaking plane P, for example towards the (not represented) front wall of housing 2, 210 in the represented example. Of course, if the electrical switching device 1, 110 is connected in the direction opposite to that represented in FIGS. 3 to 5, the electromagnetic force FE will move the electric arc E1, E2 in the opposite direction, for example towards bottom 2*a* of housing 2, 210, if the polarity of magnets 11, 12 remains unchanged. Whatever the direction of mounting of permanent magnets 11, 12, and therefore whatever their polarity, and whatever the direction of connection of the electrical switching device 1, 110 to the external electrical circuit, the two electric arcs E1 and E2 of a same breaking pole are moved and stretched in directions perpendicular to breaking plane P, these directions being parallel to each other and distant, directed either in one direction, for example towards the front wall, or in the other direction, for example towards the bottom 2*a*, of housing 2, 210. The electric arcs E1, E2 can thus be moved in a same direction or in opposite directions, without never meeting, nor interfering with each other. This configuration allows obtaining an optimized control of the electric arcs E1, E2 in an electrical switching device 1, 110 that favors their quick cooling and then their extinction. The achieved result lies in the preservation of the contact areas of the fixed contacts 3, 4, 310, 410 and of the moving contacts 5, 6, 510, 610, thus increasing their endurance thanks to the guarantee of a more efficient disconnection when disconnecting the direct current electrical circuit, allowing doing without the generally used splitting chambers and/or plates.

The symmetrical arrangement of fixed contacts 3, 4, 310, 410 and of moving contacts 5, 6, 510, 610 with respect on the one hand to median plane A or to median axis B of electrical switching device 1, 110 and, on the other hand, to breaking plane P and, consequently, the symmetrical arrangement of said permanent magnets 11, 12, allow controlling in an identical way the electric arcs E1 and E2 whatever the polarity of said magnets and the polarity of the connection of said device to the electrical circuit. This new configuration offers a significant simplification at manufacturing level, but also at assembly or even maintenance level of such an electrical switching device 1, 110, while offering an optimization of the control of the electric arcs and an increase of the disconnecting capabilities.

The whole demonstration that has been made can of course apply to single breaking poles such as the electrical switching device 100 illustrated in FIGS. 4 and 5. In this architecture form, the breaking pole comprises a first fixed contact 300 that cooperates with a moving contact 500 carried by a bridge 700 pivotable in breaking plane P around an axis C perpendicular to housing 200. This moving contact 500 is rotatably connected to a second fixed contact 400. This switching device 100 is equipped with a single magnetic module 10 comprising a permanent magnet 11 arranged symmetrically with respect to breaking plane P in front of breaking zone Z1 and housed in an insulating holder (not represented). The operating mode of magnetic module 10 is of course the same as in the previous examples.

Standardizing the permanent magnets 11, 12 allows as well standardizing the insulating holder 20 and therefore reducing the references to be manufactured and stored, simplifying the assembly and reducing the production costs. The insulating holder 20 is preferably made out of electrically insulating, molded or injection-molded synthetic or composite materials such as for example plastics. It may have a parallelepiped shape complementary to that of permanent magnets 11, 12 and defines an internal housing that is open laterally to insert one of the permanent magnets. This internal housing has a depth that corresponds at least to the width of the permanent magnet, in order to shelter it completely. Any equivalent holder shape may of course be suitable.

Figure 6:
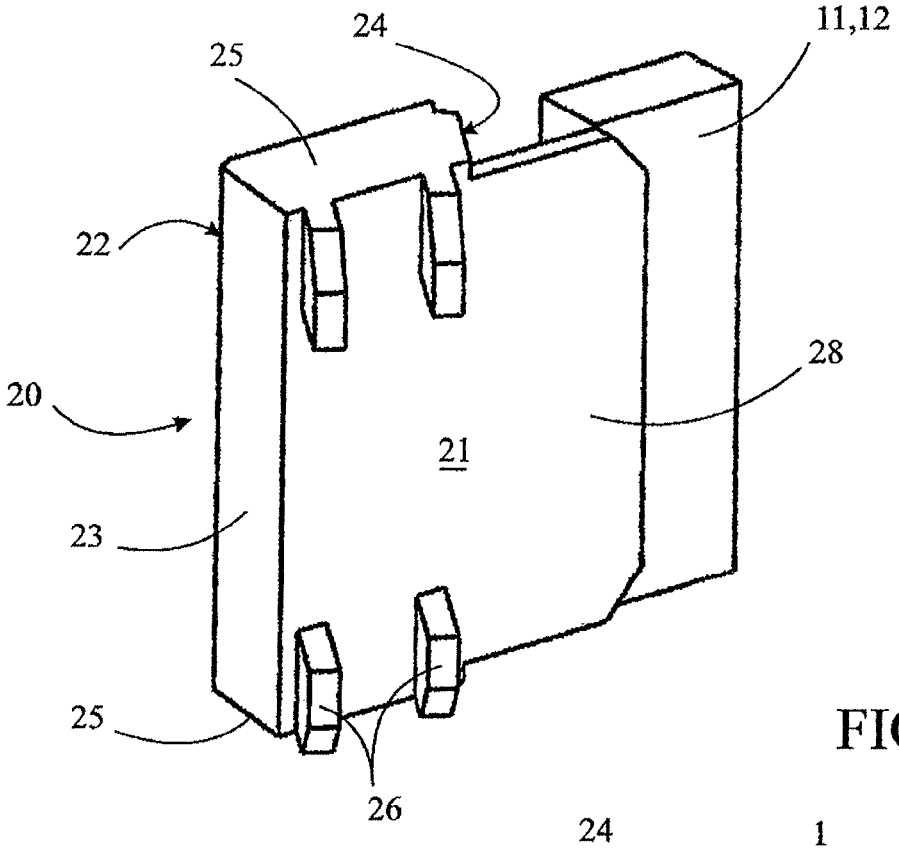
FIG. 6 is a perspective view of a magnet holder.
Figure 7:
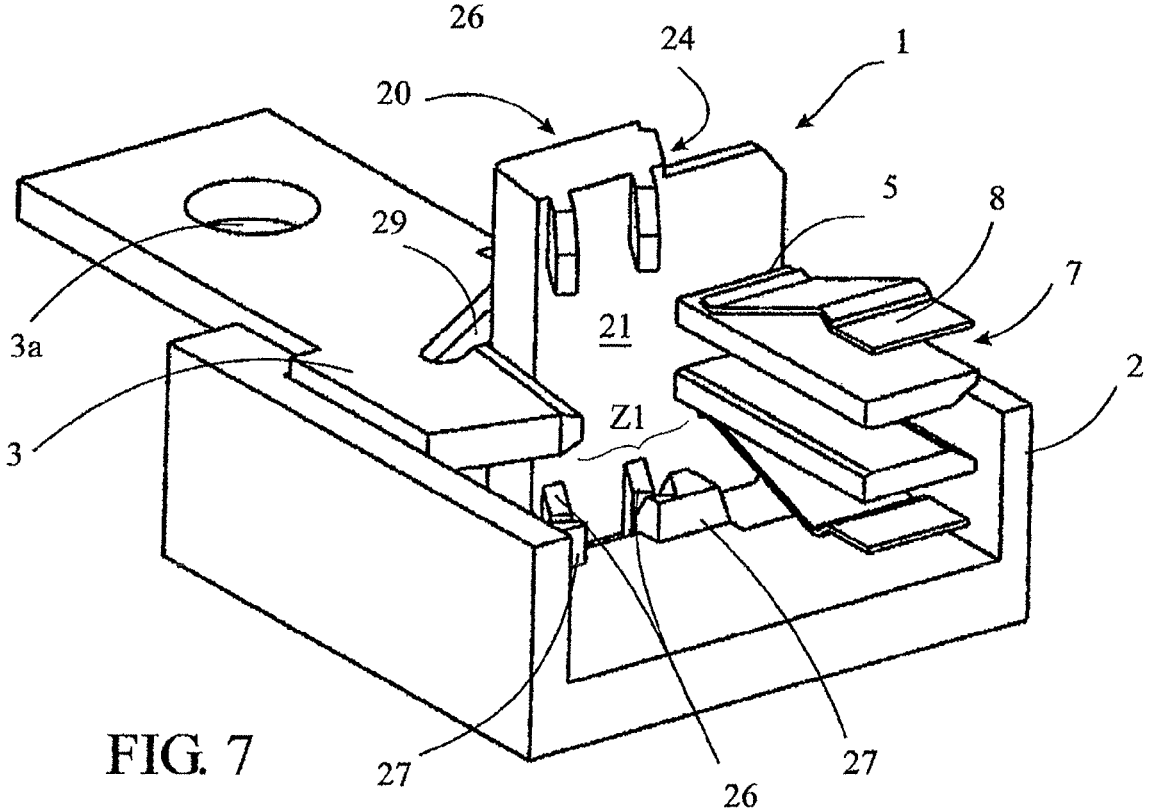
FIG. 7 is a perspective view of one half of the double breaking pole of FIG. 1, showing the location of a magnet holder.
Figure 8:
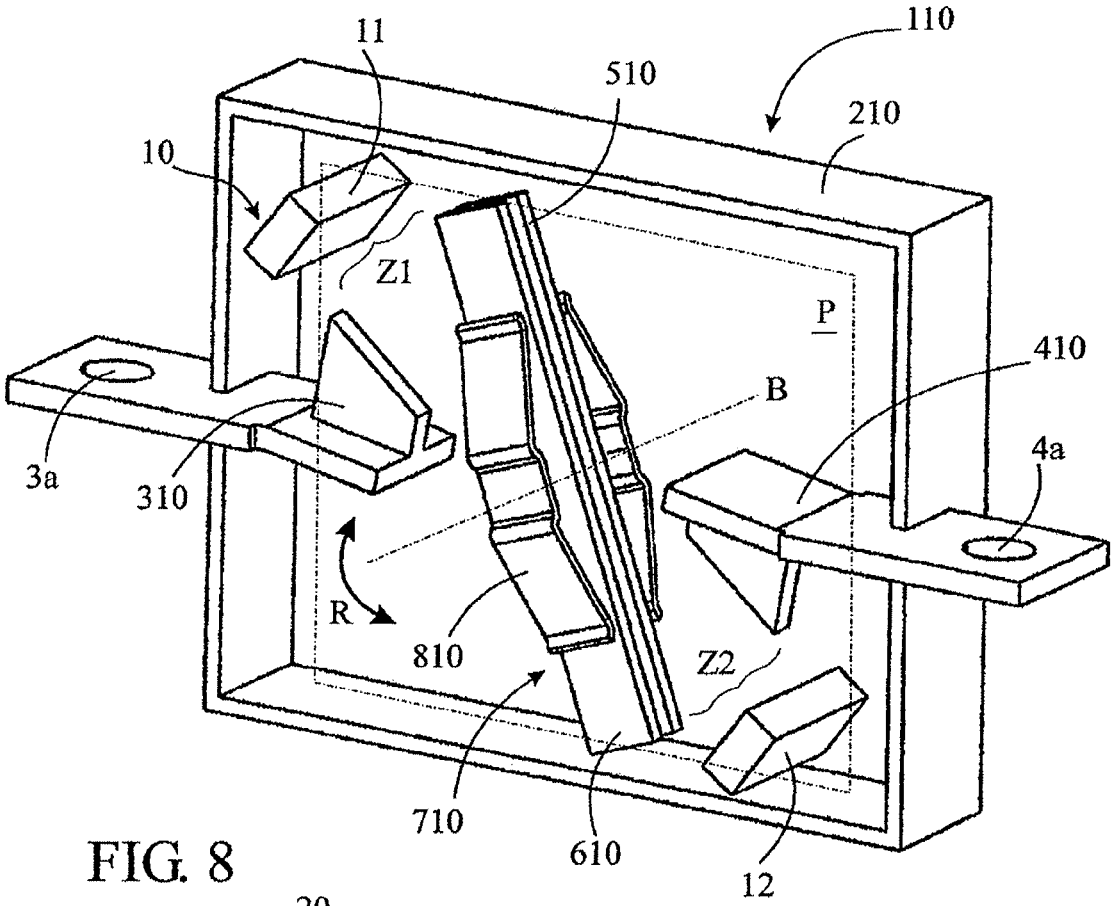
FIG. 8 is a partial perspective view of a double breaking pole according to a variant of the invention.

The insulating holder 20 illustrated in FIGS. 6 and 7 comprises a front wall 21 intended to be located in front of and parallel to a breaking zone Z1, Z2, a rear wall 22, a side wall 23 and a side opening 24 intended to be perpendicular to breaking zone Z1, Z2. It also comprises two end walls 25 and assembly means in the form of fastening tabs 26 protruding on front wall 21 and/or on rear wall 22, arranged to fit in receiving means such as notches 27 or similar provided on bottom 2*a* and/or in the front wall (not represented) of housing 2, 210 of the electrical switching device 1, 110. Its front wall 21 extends on the side of opening 24 with a deflector 28 that has the function of increasing even more the lengthening of the corresponding electric arc E1, E2 and to prevent it from moving and re-striking either on the side of permanent magnet 11, 12 accessible through side opening 24 of insulating holder 20 or on the rear section of fixed contact 3, 4, 310, 410 located behind insulating holder 20. This effect is moreover completed by a second deflector 29 formed by a wall integrated in housing 2 and located after lead chamfer 3*b*, 4*b* of fixed contact 3, 4 in order to prevent electric arc E1, E2 from moving and re-striking on the rear section of said fixed contact. In addition, these deflectors 28, 29, as well as the insulating holders 20, have the effect of absorbing the thermal energy of electric arc E1, E2, and thus of favoring its cooling and consequently its extinction.

Figure 9:
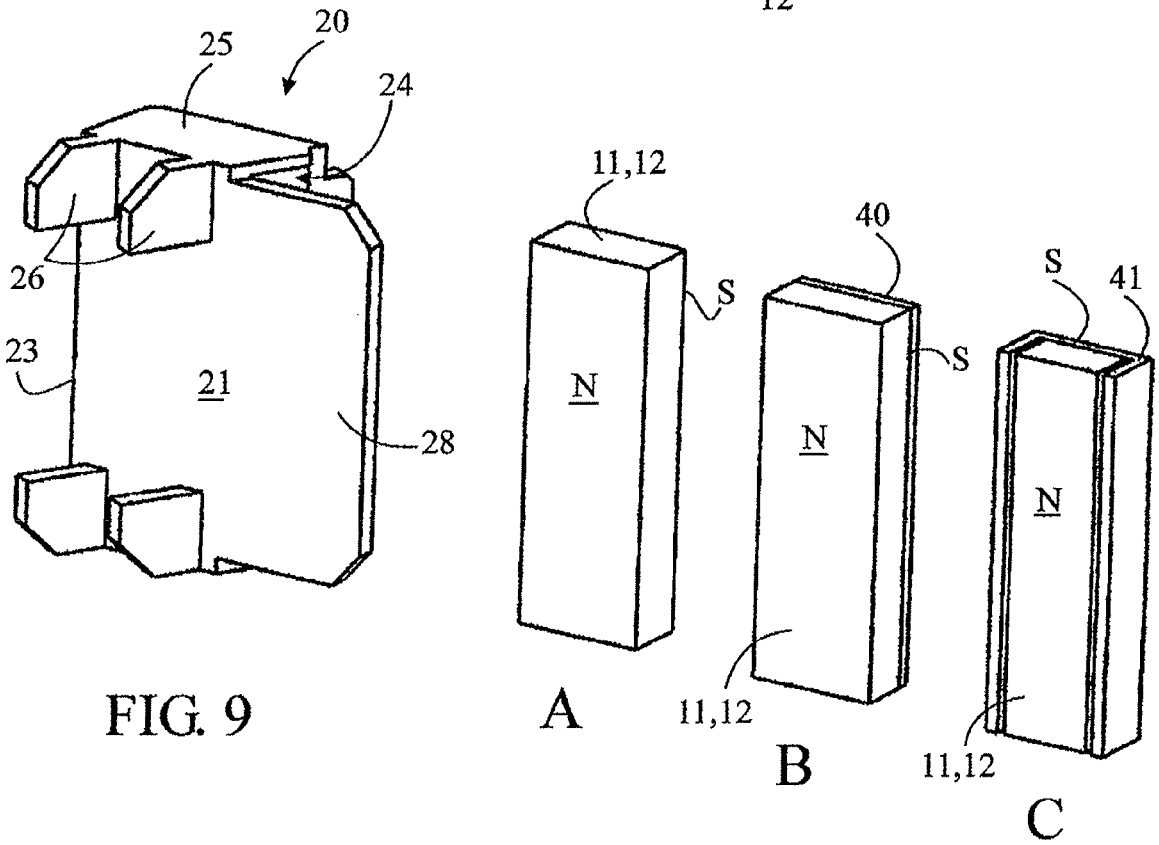
FIG. 9 is a perspective view of the magnet holder of FIG. 6 arranged to receive the permanent magnet (A) alone, then the magnet associated to a flat (B) or U-shaped (C) electric (magnetic) sheet.

The permanent magnets 11, 12 can be used alone or associated with electric (magnetic) sheets 40, 41 that have the function of canalizing the magnetic field CM produced by permanent magnets 11, 12 towards breaking zones Z1, Z2 in order to improve the magnetic blow-out of electric (magnetic) arc E1, E2 by strengthening the magnetic field CM in the breaking zones Z1, Z2 corresponding to the zones where the electric (magnetic) arc appears. FIG. 9 illustrates several embodiment examples in which, according to reference A, permanent magnet 11 is inserted alone in insulating holder 20, according to reference B, permanent magnet 11 is associated with a flat electric (magnetic) sheet 40 that covers the rear side of the magnet and, according to reference C, permanent magnet 11 is associated with a U-shaped electric (magnetic), sheet 41 that covers the rear side and both lateral sides of the magnet, this last U-shape being of course the most efficient.

Possibilities for Industrial Application

This description shows clearly that the invention allows reaching the goals defined, that is to say better disconnecting capabilities thanks to the arrangement of the permanent magnets 11, 12 as close as possible to electric arcs E1, E2. Furthermore, the polarity of the direct current connection of electrical switching device 1, 100, 110 does not depend on the polarity of said magnets and the mounting of the permanent magnets 11, 12 in housing 2, 200, 210 of said device does not depend on the polarity of said magnets. In addition, the invention can easily be adapted to different configurations or architectures of electrical switching devices 1, 100, 110 as shown respectively in FIGS. 1 to 3 and 7, 4 and 5, and 8.

The present invention is not restricted to the examples of embodiment described, but extends to any modification and variant which is obvious to a person skilled in the art while remaining within the scope of the protection defined in the attached claims.

The invention claimed is:

1. An electrical switching device (1, 100, 110), for direct current, equipped with a magnetic module for blowing an electric arc, the switching device comprising:

at least a housing (2, 200, 210) that delimits at least one breaking pole comprising at least one first fixed contact (3, 300, 310) that cooperates with at least one first moving contact (5, 500, 510), and the first moving contact being arranged so as to move between open and closed positions within a breaking plane (P) and to define, with the first fixed contact, a first breaking zone (Z1) in which a first electric arc (E1) extends upon opening the electrical circuit, wherein the magnetic module comprises at least a first permanent magnet (11) housed in at least a first insulating holder (20), the first permanent magnet is an independent permanent north-south magnet whose magnetic field loops on itself, with north-south sides perpendicular to the breaking plane (P), and arranged immediately adjacent to the first breaking zone (Z1), symmetrically with respect to the breaking plane (P) and oriented so as to generate a magnetic excitation vector which extends parallel to the breaking plane (P) so that an induced electromagnetic force (FE) moves and stretches the first electric arc (E1) perpendicularly to the breaking plane (P), independently of a direction of a polarity of the at least one of the first permanent magnet and of the current.

2. The device according to claim 1, further comprising in the breaking pole, a second fixed contact (4, 400, 410) cooperates with a second moving contact (6, 600, 610), the second moving contact is linked to the first moving contact and arranged to move in the breaking plane (P) and define, with the second fixed contact, a second breaking zone (Z2) in which a second electric arc (E2) extends upon opening the electrical circuit, wherein the magnetic module comprises a second permanent magnet (12) housed in a second insulating holder (20), the second permanent magnet is an independent permanent north-south magnet whose magnetic field loops on itself, with north-south sides perpendicular to the breaking plane (P), and arranged immediately adjacent to the second breaking zone (Z2), symmetrically with respect to the breaking plane (P) and oriented so as to generate a magnetic excitation vector which extends parallel to the breaking plane (P) so that an induced electromagnetic force (FE) moves and stretches the second electric arc (E2) perpendicularly to the breaking plane (P), in one direction or another, according to a polarity of at least one of the second permanent magnet and of the current, and the first and the second permanent magnets (11, 12) are arranged spaced from one another, symmetrically with respect to a median axis or to a median plane of the device so that the electromagnetic forces (FE), induced by the first and second permanent magnets (11, 12), have parallel and spaced directions.

3. The device according to claim 1, wherein the electromagnetic force (FE), induced by the permanent magnet (11, 12), is perpendicular to two walls of the housing which are parallel and symmetrical with respect to the breaking plane (P) of the housing (2, 200, 210) of the electrical switching device (1, 100, 110).

4. The device according to claim 2, wherein the first and the second permanent magnets (11, 12) are identical, parallel and spaced from one another so that their respective magnetic fields (CM) do not interfere with one another.

5. The device according to claim 4, wherein the first and the second insulating holders (20) are identical to one another.

6. The device according to claim 5, wherein the insulating holder (20) comprises assembly means (26), complementary to receiving means (27) provided in housing (2, 200, 210) of the electrical switching device (1, 100, 110), in order to position the insulating holder (20) in front of and parallel to the breaking zone (Z1, Z2).

7. The device according to claim 6, wherein the insulating holder (20) comprises a housing provided with a side opening (24) that extends perpendicularly to the breaking zone (Z1, Z2) and in which the first permanent magnet (11, 12) is inserted.

8. The device according to claim 7, wherein the insulating holder (20) extends on the side of its side opening (24) and in front of the breaking zone (Z1, Z2) with at least one deflector (28) that extends parallel and in front of the breaking zone (Z1, Z2) so as to protect the permanent magnet (11, 12) against the electric arc (E1, E2).

9. The device according to claim 1, wherein the permanent magnet (11, 12) is associated with at least one electric sheet (40, 41) arranged so as to canalize the magnetic flux of the permanent magnet toward the breaking zone (Z1, Z2).

10. The device according to claim 9, wherein the electric sheet is housed with the permanent magnet in the insulating holder (20).

11. The device according to claim 9, wherein the electric sheet (40) has a flat shape and covers a rear side of the permanent magnet (11, 12) opposite to the breaking zone (Z1, Z2).

12. The device according to claim 9, wherein the electric sheet (40) has a U-shape and covers the rear side of the permanent magnet (11, 12) opposite to the breaking zone (Z1, Z2) and its two lateral sides.

13. The device according to claim 2, wherein the electromagnetic force (FE), induced by the permanent magnet (11, 12), is perpendicular to two walls of the housing which are parallel and symmetrical with respect to the breaking plane (P) of the housing (2, 200, 210) of the electrical switching device (1, 100, 110).

* * * * *